US006408725B1

(12) United States Patent
Janson

(10) Patent No.: US 6,408,725 B1
(45) Date of Patent: Jun. 25, 2002

(54) PLIERS

(76) Inventor: Paul M. Janson, 19151 Tulsa St., Northridge, CA (US) 91326

( * ) Notice: Subject to any disclaimer, the term of this patent is extended or adjusted under 35 U.S.C. 154(b) by 0 days.

(21) Appl. No.: 09/879,264

(22) Filed: Jun. 12, 2001

Related U.S. Application Data

(60) Provisional application No. 60/285,047, filed on Apr. 20, 2001.

(51) Int. Cl.[7] ..... B25B 7/04
(52) U.S. Cl. ..... 81/407; 81/382
(58) Field of Search ..... 81/381, 382, 383, 81/407, 408, 409, 409.5, 412

(56) References Cited

U.S. PATENT DOCUMENTS

| | | | | | |
|---|---|---|---|---|---|
| 832,804 | A | | 10/1906 | Oneal et al. | |
| 1,541,248 | A | * | 6/1925 | Carlson | 81/382 |
| 1,763,527 | A | * | 6/1930 | Jones | 81/412 |
| 1,915,404 | A | * | 6/1933 | Clifton | 81/365 |
| 2,144,180 | A | * | 1/1939 | Cruickshank | 81/382 |
| 3,704,620 | A | | 12/1972 | Allen | |
| 4,229,924 | A | * | 10/1980 | Teachout, Sr. | 53/399 |
| 4,569,132 | A | | 2/1986 | Hill | |
| 4,893,530 | A | | 1/1990 | Warheit | |
| 5,904,078 | A | * | 5/1999 | Gustafson et al. | 81/417 |
| 6,065,376 | A | | 5/2000 | Khachatoorian | |

* cited by examiner

*Primary Examiner*—Joseph J. Hail, III
*Assistant Examiner*—David B. Thomas
(74) *Attorney, Agent, or Firm*—Stanton E. Collier

(57) ABSTRACT

Slip-joint pliers of the present invention comprise, in one embodiment, a pair of compound handles pivotally attached to jaw means being upper and lower jaw members having a manually adjustable slip-joint therein for providing at least two different maximum jaw opening positions, each having a different separation angle. The jaw openings are selectable by movement of a lever, for example, attached to a keyed pivot pin in the slip-joint. The jaw openings are selectable with minimal movement of the compound handles as a result of spring biasing between the jaw members and abutting engagement with the compound handles. A further embodiment without the compound handles has the spring biasing between the jaw arms and a limiting bracket, for example, mounted on pivot pins in the handles attached to the jaw arms to restrict the separation of the handles in an outwardly direction so that the spring will constantly bias the jaw arms apart so that the operation of the lever described herein, or other device, functions in a similar manner as in the compound pliers. In the first embodiment, for example, operation of the manual slip-joint causes the jaw members to automatically separate to achieve a large maximum jaw opening position. The method of using the pliers of the present invention requires that the manually adjustable slip-joint be positioned in a disengaged mode to allow the jaw members to move to a predetermined separation angle. At which point, the slip-joint is engaged which allows the use of the pliers to grip work pieces of different sizes. By use of either one or both hands, the jaw members may be moved to another predetermined separation angle.

32 Claims, 14 Drawing Sheets

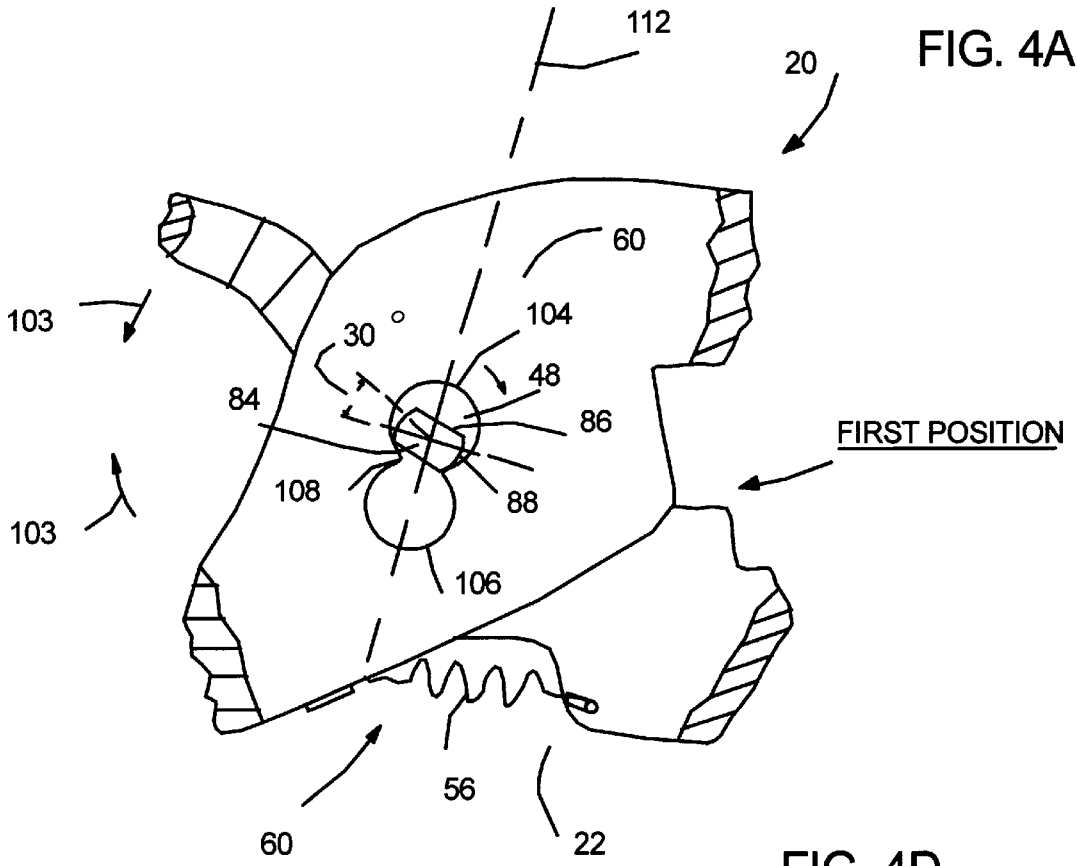
FIG. 4A
FIG. 4D
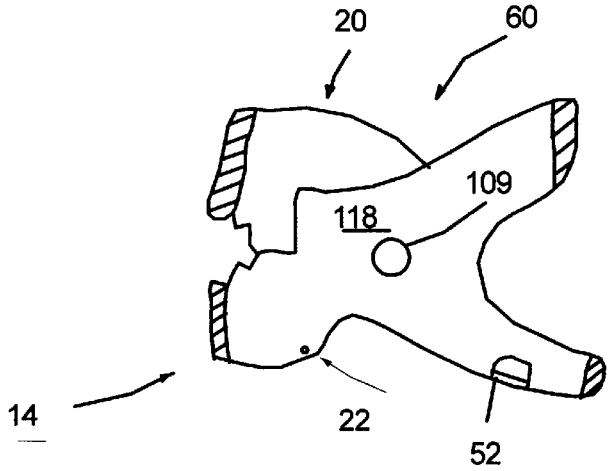

FIRST POSITION

FIRST POSITION

PLIERS

CROSS-REFERENCES TO RELATED PATENT APPLICATIONS

A provisional patent application entitled "Pliers" by the same inventor with Ser. No. 60/285,047 was filed Apr. 20, 2001 in the United States Patent and Trademark Office and is hereby incorporate by reference.

STATEMENT REGARDING FEDERALLY SPONSORED RESEARCH OR DEVELOPMENT

None.

BACKGROUND OF THE INVENTION

1. Field of the Invention

The present invention relates to hand tools, and, in particular, relates to pliers, and, in greater particularity, relates to pliers having an adjustable jaw opening to fit different sizes of work pieces.

2. Description of Related Art

The following prior art examples of pliers are incorporated by reference:

One prior art example is long handled, slip-joint pliers having an offset jaw opening with five position settings such as shown by Craftsman model WF 7945381. The handles must be separated by about 90 degrees before any adjustment is allowed which restricts adjustment in close working quarters and the offset jaw opening limits the spaces into which it may be used.

Another prior art example is short handled, slip-joint pliers with a jaw opening symmetrical about a center line through the handles and having only two position settings such as a Craftsman model WF 7945378. The handles must be separated by about 90 degrees before any adjustment is allowed thus restricting changing the settings in close working quarters.

Another prior art example is short handled, slip-joint pliers having a range of continuous jaw openings with a maximum separation angle with laminated construction such as a Stanley model 84-881. The separation angle being solely determined by the size of the work piece upon engagement.

U.S. Pat. No. 6,065,376 discloses automatically adjustable pliers having an offset jaw opening with laminated construction with only a single compound handle.

U.S. Pat. No. 4,893,530 discloses pliers having a control arm between the handles with spring biasing at each end thereof.

U.S. Pat. No. 4,569,132 discloses a cutting tool with compound handles.

U.S. Pat. No. 3,704,620 discloses a compound action tool for crimping purposes with a pair of jaws.

U.S. Pat. No. 832,804 discloses a cutting tool having compound handles wherein the jaw opening is not adjustable for different sized work pieces.

Thus, there exists a need for a manually adjustable slip-joint pliers having selective separation angles between the jaw members for gripping work pieces of different sizes and further allowing adjustment with minimal movement of the handles of the pliers.

BRIEF SUMMARY OF THE INVENTION

Slip-joint pliers of the present invention comprise, in one embodiment, a pair of compound handles pivotally attached to jaw means being upper and lower jaw members having a manually adjustable slip-joint therein for providing at least two different maximum jaw opening positions, each having a different separation angle. The jaw openings are selectable by movement of a lever, for example, attached to a keyed pivot pin in the slip-joint. Further, the jaw openings are selectable with minimal movement of the compound handles as a result of spring biasing between the jaw members. A further embodiment without the compound handles has the spring biasing between the jaw arms and a sliding bracket mounted on pivot pins in the handles attached to the jaw arms to restrict the separation of the handles in an outwardly direction so that the spring will constantly bias the jaw arms apart such that the operation of the lever described herein, or other device, allows the jaw members to be adjusted.

The method of using the pliers of the present invention requires that the manually adjustable slip-joint be positioned in a disengaged mode to allow the jaw members to be moved to a predetermined separation angle. At which point, the slip-joint is engaged which allows the use of the pliers to grip work pieces of different sizes. By use of either one or both hands, the jaw members may be moved to another predetermined separation angle.

Therefore, one object of the present invention is to provide improved pliers with a slip-joint that is spring biased so that jaw members may have several different separation angles for gripping work pieces of different sizes.

Another object of the present invention is to provide compound pliers with the manually adjustable slip-joint having several jaw openings to accommodate different sized work pieces.

Another object of the present invention is to provide compound pliers having several jaw openings which may be selected quickly and easily with either one or both hands by the use of the manually adjustable slip-joint.

Another object of the present invention is to provide compound pliers having several jaw openings which may be selected with minimal movement of the compound handles to allow adjustment.

Another object of the present invention is to provide improved pliers having several jaw openings which may be selected with minimal movement of the handles to allow adjustment.

Another object of the present invention is to provide compound pliers having several jaw openings which may be selected in close quarters.

Another object of the present invention is to provide compound pliers having several jaw openings which may grip the work piece straight on as compared to offset jaws.

These and many other objects and advantages of the present invention will be ready apparent to one skilled in the pertinent art from the following detailed description of a preferred embodiment of the invention and the related drawings.

BRIEF DESCRIPTION OF THE SEVERAL VIEWS OF THE DRAWINGS

FIG. 4A is a partial side elevation view of the pliers of FIG. 3A with a nut and washer removed from a partially threaded keyed pivot pin to reveal the keyed pivot pin within a first aperture of a slip-joint in the first maximum jaw opening position;

FIG. 4D is a partial side elevation view of the pliers of FIG. 1 showing the levered side with the lever and keyed pivot pin removed from an aperture in the levered side of the upper jaw member;

When referring to the figures from the detailed description, identical or very similar parts are designated by the same item numbers in the figures.

DETAILED DESCRIPTION OF THE INVENTION

Figure 1:
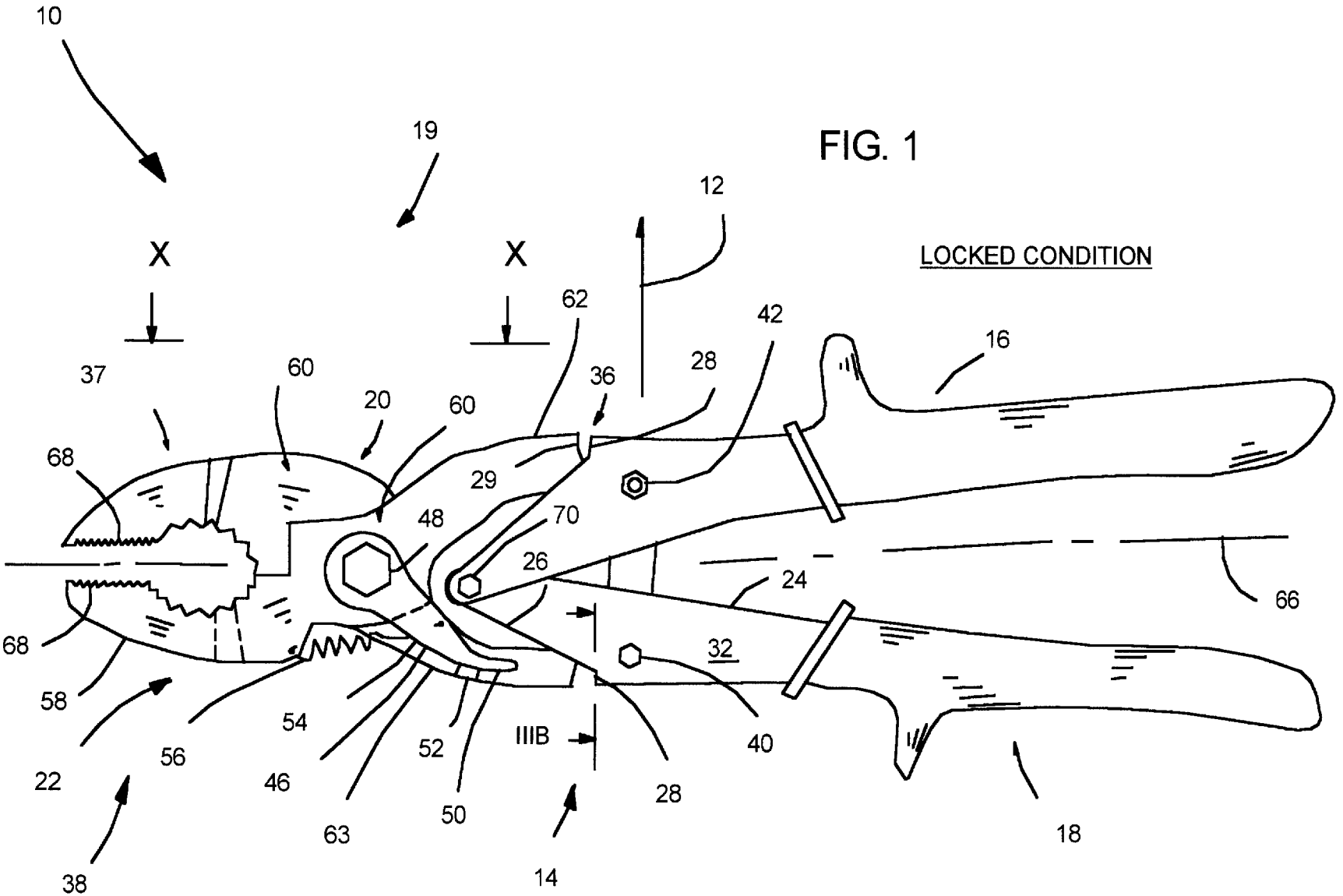
FIG. 1 is a side elevation view of a levered side of the compound pliers of the present invention in a locked condition and seen from a side from which a right-handed person would hold the pliers.

Referring to FIG. 1, compound pliers 10 is shown by side elevation view with the vertical direction being indicated by an arrow 12 for the purpose of providing an orientation to other views and a longitudinal center axis 66 being perpendicular to the arrow 12. FIG. 1 further illustrates an embodiment of the pliers 10 with a levered side 14 of the pliers 10 which would be clearly visible to a person holding the pliers 10 by the right hand. The pliers 10 may be operated by a person being either left-handed or right-handed.

A compound upper handle and a compound lower handle 16 and 18, respectively, are pivotally connected together by a screw and nut combination 70 and also connected pivotally to jaw means 19 being an upper jaw member 20 and a lower jaw member 22 to be further described. The description of the upper jaw member 20 and the lower jaw member 22 as being an upper or lower item is merely for orientation and may also be referred to herein as the first jaw member or second jaw member, respectively. The upper or first jaw member having multiple apertures therein to be disclosed herein. The rotation of the improved pliers 180 degrees about a longitudinal center axis places the multiple apertures in the lower jaw member. In order to provide a consistent explanation of the construction and operation of the improved pliers 10, the orientation of the improved pliers will be limited to those shown in FIG. 1 and FIG. 3A. FIG. 1 illustrates a locked condition of the pliers 10 which minimizes the vertical width of the pliers 10 for storage.

The construction, the covering, the biasing, the locking, the pivotal attachment of the compound handles 16 and 18 are considered conventional and are shown in U.S. Pat. No. 4,569,132 which is incorporated by reference. Unless stated otherwise, the features of one compound handle are similar to the other compound handle. The jaw means 19 may be constructed of solid steel or steel alloy by conventional means for making tools of this type.

Figure 3A:
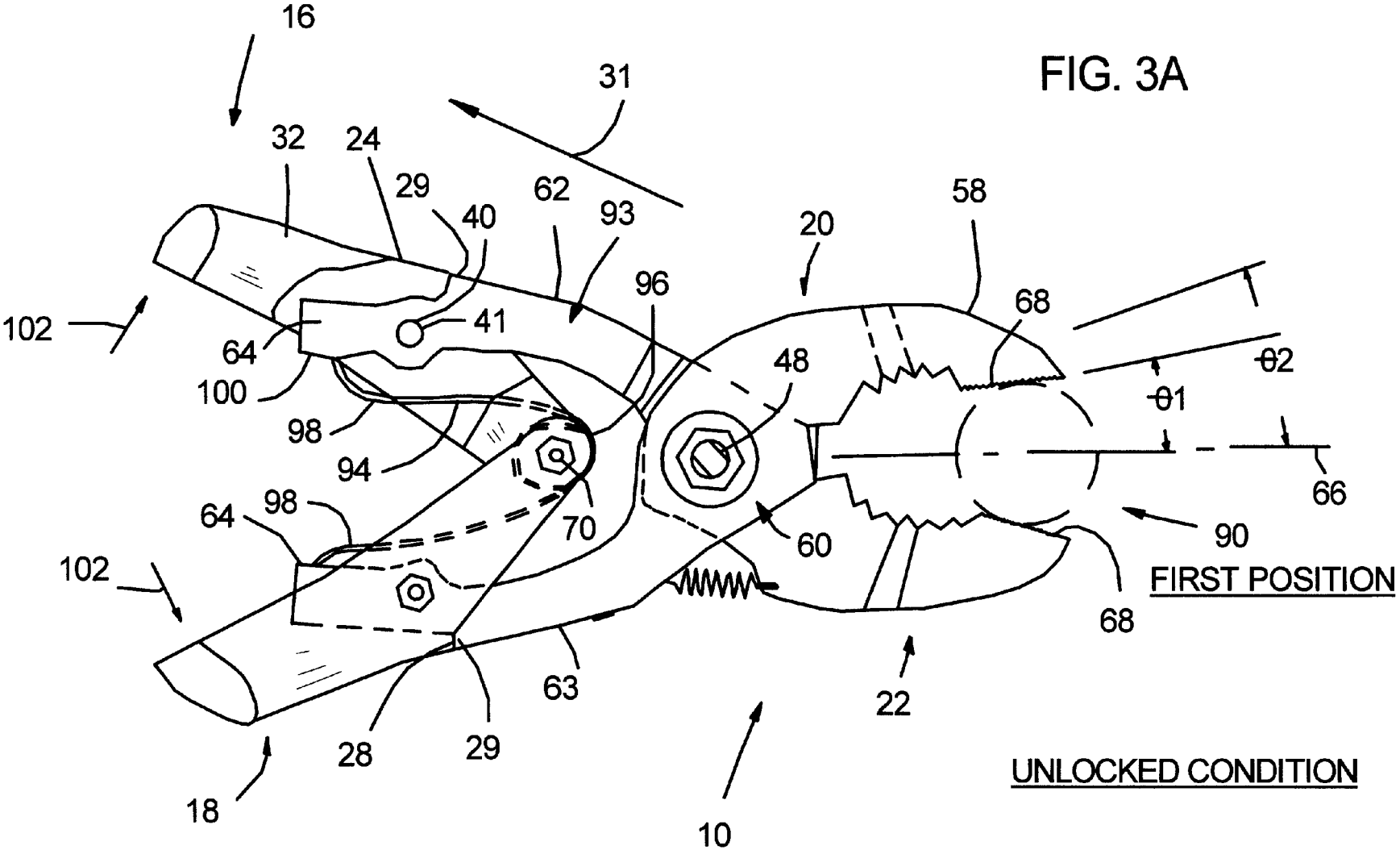
FIG. 3A is a partial side elevation view of the compound pliers in an unlocked condition and the jaws of the pliers in a first maximum jaw opening position being defined as a smaller opening therebetween and having a work piece shown between the jaw faces.
Figure 3B:
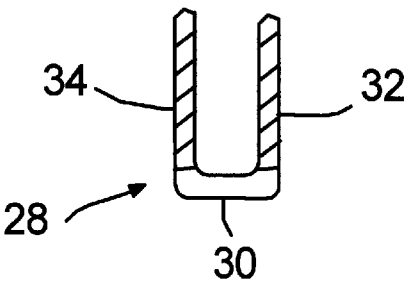
FIG. 3B is a front elevation view of a stop being an integral part of a handle member for receiving an abutment member of an arm of the jaws.

Compound lower handle 18 has a handle member 24 and an extension member 26 with a stop 28 being substantially vertical as shown in FIG. 3B and is formed by an end of a top wall 30 being an integral part of the side walls 32 and 34 of the handle member 24. In the locked condition as shown in FIG. 1, the lower jaw member 22 does not abut against the stop 28 as shown by a gap 36, as compared to the unlocked condition shown in FIG. 3A where an abutment 29 of an lower arm 63 contacts the stop 28. This action further prevents the separating of the handles 16 and 18 as the jaw members 20 and 22 are at the maximum separation angle for that position, the first position being shown in FIG. 3A. By moving the position of the stop 28 in the handle member 24 in the direction of arrow 31, a different separation angle may be provided in the first position.

Figure 10A:
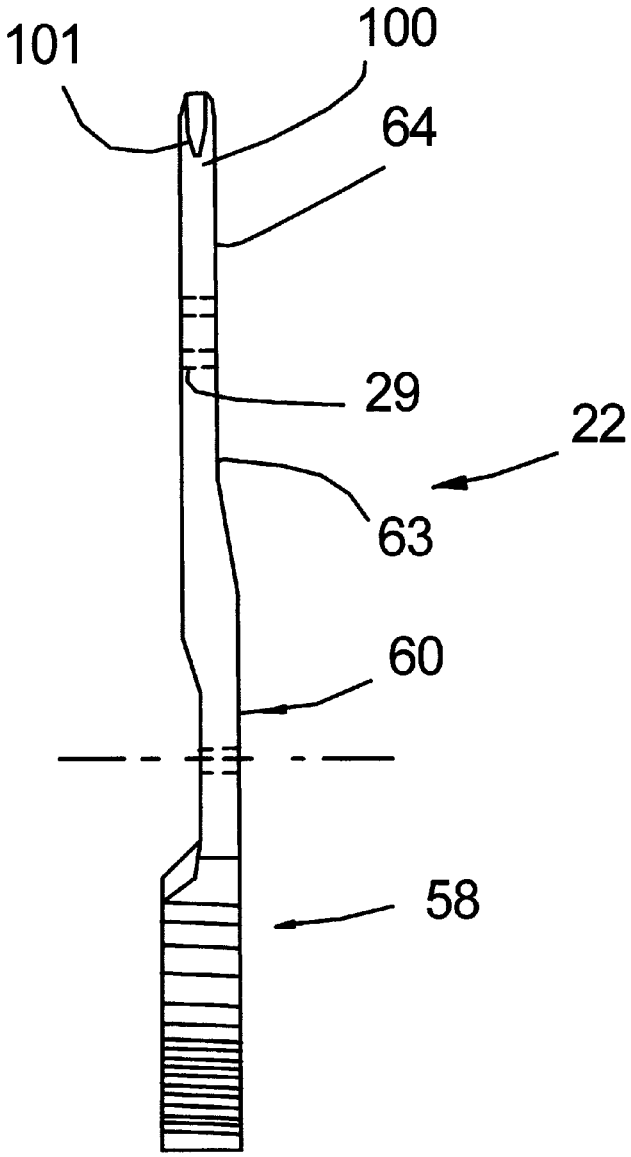
FIG. 10A is a top view of the lower jaw member of FIG. 1.
Figure 10B:
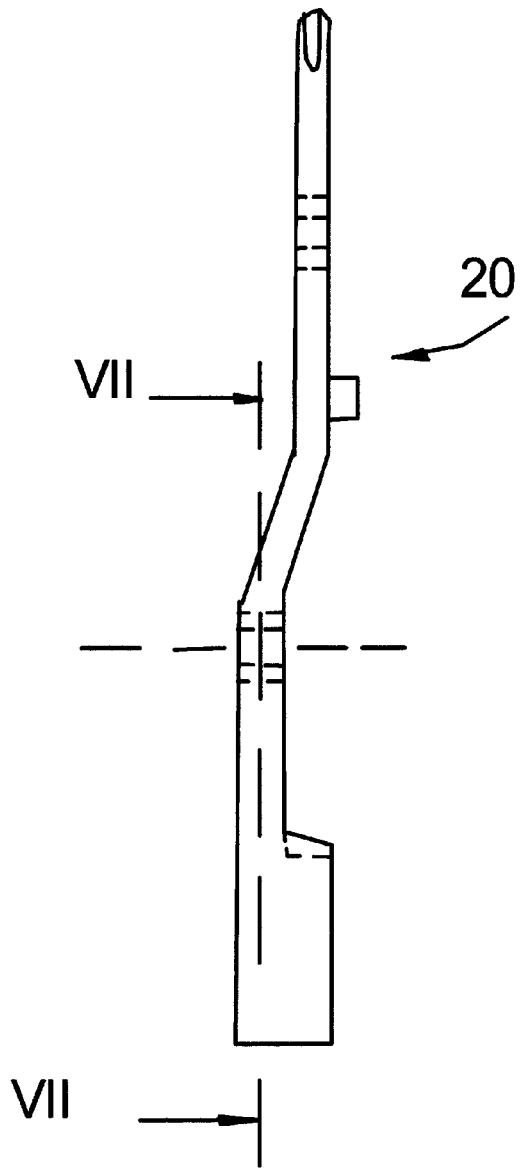
FIG. 10B is a top view of the upper jaw member of FIG. 1.

Still referring to FIG. 1, pliers jaws 38 are formed by the combination of the upper jaw member 20 and the lower jaw member 22 being, respectively, pivotally connected to the lower handle 18 and the upper handle 16 by, respectively, a machine screw and nut at two different locations to be detailed hereinafter. The nuts disclosed herein for the pliers 10 may be of a locking type to prevent accidental unscrewing, etc., from the screws. A machine screw 40 and a nut 42 are shown in FIG. 1. Further, the upper jaw member 20 and the lower jaw member 22 are pivotally connected together by means of a manually adjustable slip-joint 60. The lower jaw member 22 comprises a jaw 58, an arm 62, and a pivot arm 64 (FIG. 3A). The lower jaw member 22 is further seen by top view in FIG. 10A. The upper jaw member 20 is similarly constructed as the lower jaw member 22 except for the features required for the attachment of the slip-joint 60 and the stop 52 attached to the arm 63 to be further detailed. The stop 52 may be a right angle bracket riveted, welded or integrally form to the lower arm 63.

Figure 4B:
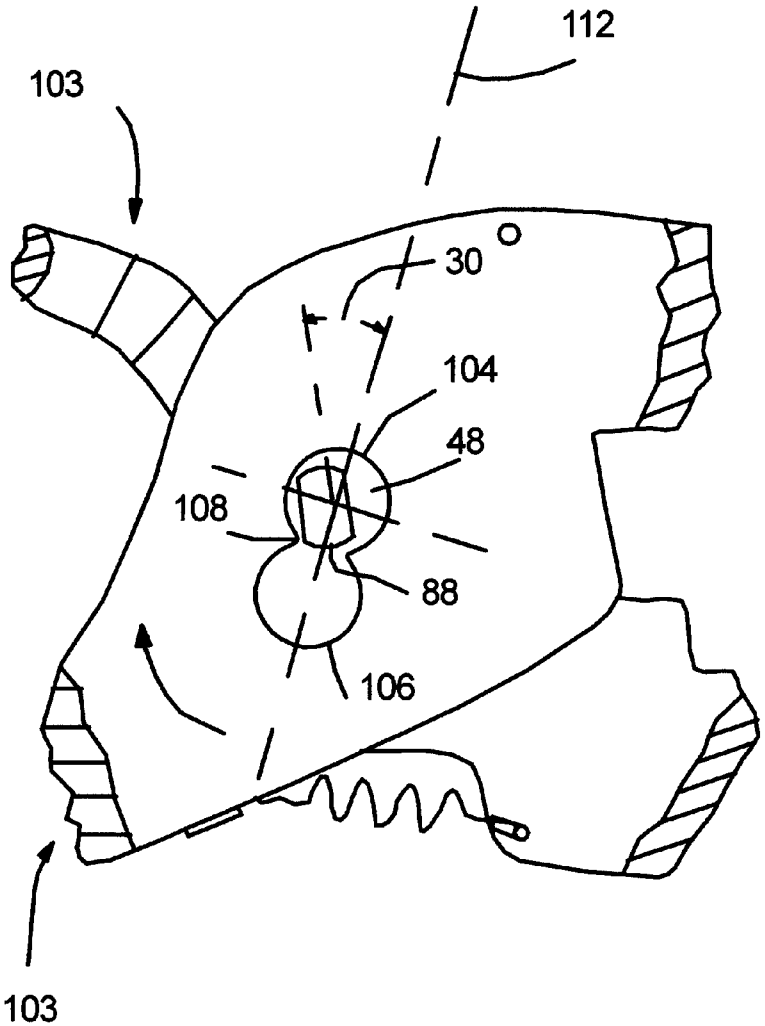
FIG. 4B is a partial side elevation view of the pliers of FIG. 4A showing the keyed pivot pin rotated in a clockwise direction for passing the keyed pivot pin through a neck opening between the first aperture and a second aperture of the slip-joint.
Figure 12A:
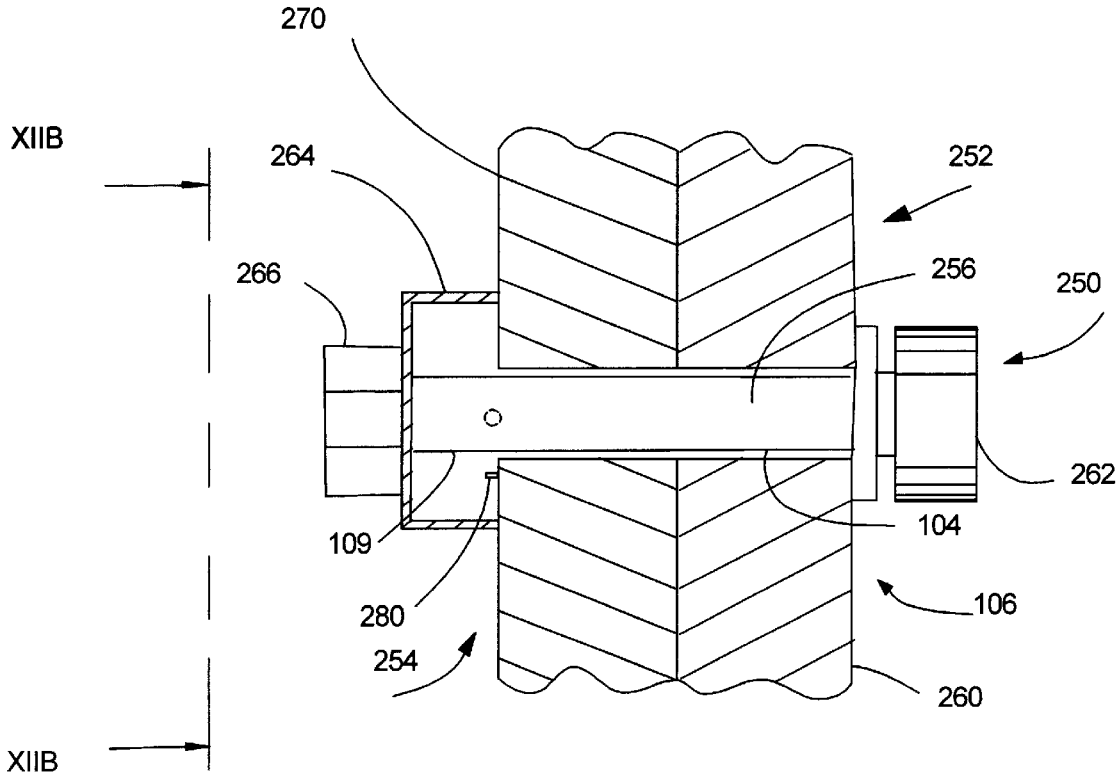
FIG. 12A illustrates by a top view a partial cross section through the jaw members having a spring biased keyed pivot pin with a finger operable wing thereon.
Figure 12B:
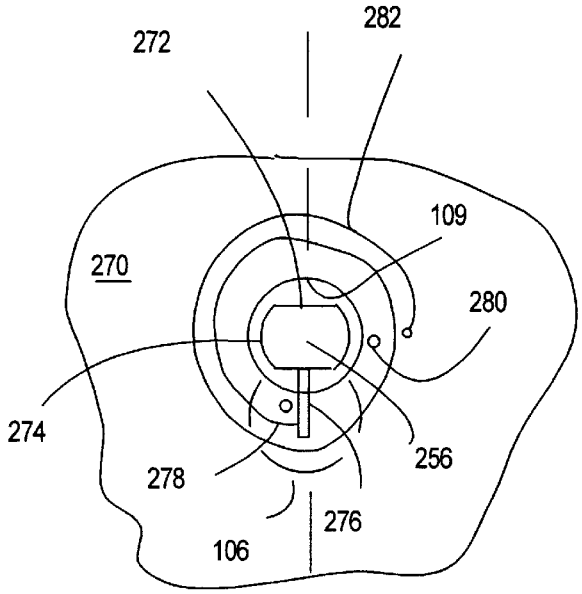
FIG. 12B illustrates by a partial side elevation view a spring biasing of the keyed pivot pin of FIG. 12A.

As seen in FIG. 1, a keyed lever 46 (shown by itself in FIG. 5B) is mounted on a keyed pivot pin 48 (shown by itself in FIG. 5A), and a lever handle 50 of the lever 46 normally rests against the stop 52 that is fixedly attached to the upper jaw member 20 on the lower arm 63 holding the keyed pivot pin 48 in the position shown in FIG. 4A. A biasing spring 56, normally in a contracting biased condition, is attached between a middle section 54 of the lever 46 and the jaw 58, biasing the lever 46 against the stop 52. In this regard, the keyed pivot pin 48 is held in a stationary position relative to the upper jaw member 20 while the lower jaw member 22 rotates on the keyed pivot pin 48 in all situations except when the lever 46 is moved by hand. The lever 46 is only rotated in the counter-clockwise direction by hand operation away from the stop 52. The rotation of the keyed pivot pin 48, also seen in FIG. 4A, by about 30 degrees will disengage the pin 48 from the first aperture 104, FIG. 4B, to drop into the second aperture 106, FIG. 4C. The configuration shown in FIG. 4A occurs when the pliers 10 are in use. The approximate 30 degree clockwise rotation is in addition to that already shown to disengage the pivot pin 48. In a different embodiment as seen in FIG. 12A and FIG. 12B, a keyed pivot pin 256 is biased against a stop pin 278 on a lower jaw member 254 having a single aperture 109 therein. Another embodiment shown in FIG. 8 uses a non-keyed pivot pin 148 only operated by a push button. The means of hand operating the slip-joint 60 may include other embodiments than shown but are considered within the invention scope of the present patent application.

As further seen in FIG. 1, the compound pliers 10 of the present invention has the longitudinal center axis 66 with the jaw faces 68 substantially parallel to the center axis 66 in the locked condition. This allows the compound pliers 10 to be inserted straight on into small spaces and gripped about a work piece such as a pipe 73, shown in outline in FIG. 3A, as contrasted to the offset jaws of the prior art.

Figure 2:
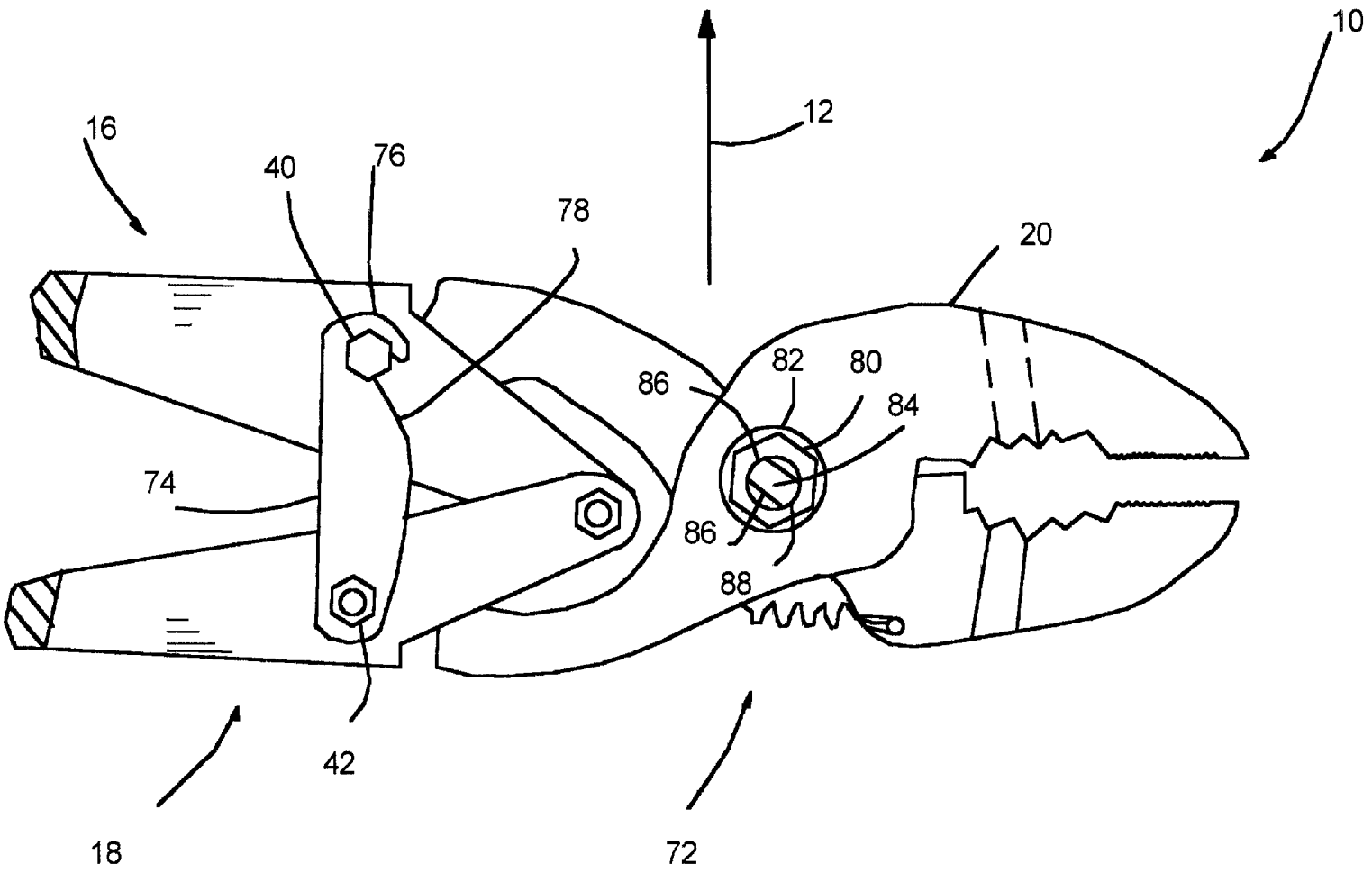
FIG. 2 is a partial side elevation view of the other side, the non-levered side, of the compound pliers of FIG. 1 when rotated 180 degrees when viewed from a vertical direction as shown by a vertical arrow in FIG. 1.

Upon rotating the pliers of FIG. 1 by 180 degrees about the vertical arrow 12, an unlevered side 72 of the compound pliers 10 is shown in FIG. 2. A locking latch 74 is pivotally mounted to the lower handle 18 by means of a screw and a nut combination 42. The locking latch 74 has a hook portion 76 which can be pivotally engaged to an extended portion of screw 40 which may have a bushing thereon to provide a smooth engagement surface for the hook portion 76. Because the handles 16 and 18 are not fully contracted when in the locked condition further contracting of the handles 16 and 18 causes a ramp section 78 of the latch 74 to engage the screw 40 and move away from the screw 40 to unlock itself.

Another feature shown on the unlevered side 72 is a washer 82 and a lock nut 80, for example, placed on an end 84 of the keyed pivot pin 48 to secure the keyed pivot pin 48 to the pliers 10. The lock nut 80 is not fully tightened down on pin 48 so that there is sufficient play to allow the jaw means 19 to rotate thereon.

Figure 5A:
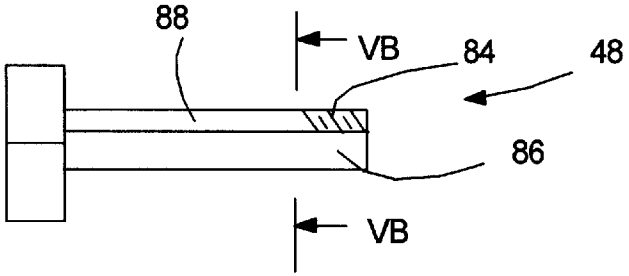
FIGS. 5A and 5B is a side elevation view and a cross sectional view, respectively, of the partially threaded keyed pivot pin.
Figure 5C:
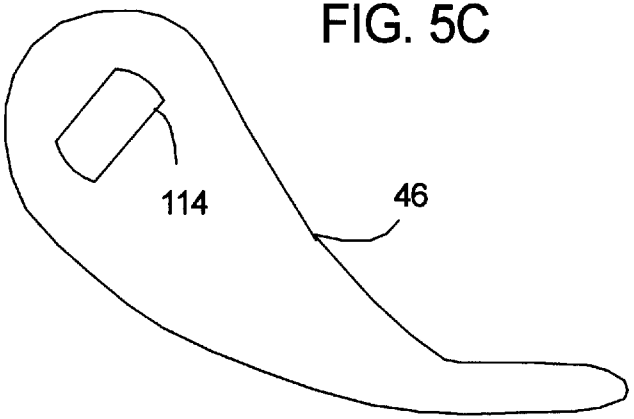
FIG. 5C is a side elevation view of the lever having a keyed opening to fit over the keyed pivot pin of FIG. 5A.
Figure 5B:
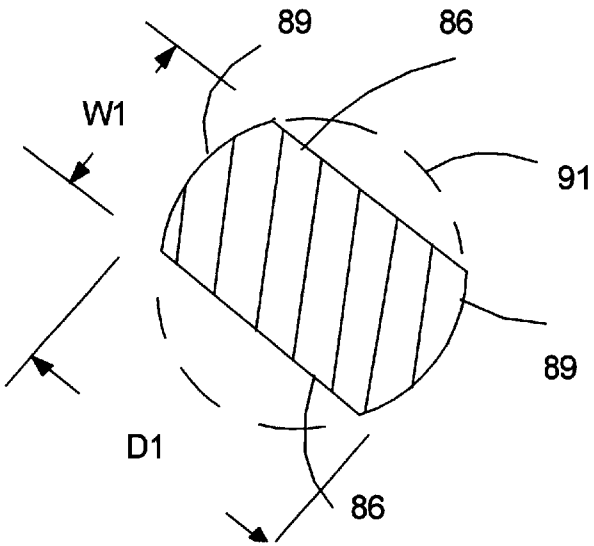

Referring to FIG. 5A, the side view shows the pivot pin 48 with partially threaded sides 88, only one shown, and with flat sides 86, only one shown. FIG. 5B is a cross section through the pin 48 illustrating its rectangular like shape with flat sides 86 being the longer sides and the distance between the flat sides 86 being denoted as W1 and having a width slightly less than the distance between the sides of the neck opening 108. The shorter sides of the rectangular like shape are curved sides 89 and the distance between the curved sides 89 is denoted as D1 and has a length slightly less than the diameter of the apertures 104 and 106. The surfaces on the curved side 86 are part of a cylindrical surface 91 having a diameter D1. Hereafter, the curved sides 89 may be referred to as threaded sides 88 although only partially threaded as seen in FIG. 5A. In order to minimize the play between the jaw members, the distance D1 should be slightly less than the diameter of the apertures 104 and 106 and further the curved sides 89 must have a width W1 sufficient to bear the forces placed thereon by the jaw members.

Upon contracting of the handles 16 and 18 together, latch 74 unlocks and the pliers 10 assume the unlocked condition shown in FIG. 3A due to spring force to be detailed herein. FIG. 3A further illustrates the jaw 58 being in a first maximum jaw opening position 90 wherein the approximate angle of the jaw face 68 from the center axis 66 as measured from the pivot pin 48 is approximately 10 to 15 degrees and is represented by the angle Θ1. The first maximum jaw opening position 90 defining the smallest opening between the jaw faces 68. The jaw 58 when rotated to a second maximum jaw opening position 92 (FIG. 4C) is at an approximate angle of 20 to 25 degrees from the center axis 66 which defines a second maximum jaw opening position 92 as represented by the angle Θ2. These angles may vary from those noted due to different shapes of jaws, etc.

A portion of the side wall 32 of the handle member 24 has been removed in FIG. 3A to reveal the pivot arm 64 of the lower jaw member 22 with the attaching screw removed. A biasing means 93 is provided by a spring 94 which has a coiled portion 96 placed over the screw 70 upon which upper and lower handles 16 and 18 pivot. The end 98 may rest in a groove 101, FIG. 10A, formed on the interior surface 100 to prevent the spring end 98 from slipping therefrom. The spring 94 is normally in the expanding biasing mode where the ends 98 of the spring 94 are placed on interior surfaces 100 of the pivot arms 64 and beyond the pivot screws 40 to further bias the handles 16 and 18 to the position shown in FIG. 3A and in the direction of the arrows 102. As further seen therein, the force of the biasing means 93 causes the upper handle 16 and the lower handle 18 to rotate about the pivot point as provided by screw 70, clockwise and counter-clockwise respectively. The stops 28 acting against the abutments 29 will further urge the upper jaw member 20 and the lower jaw member 22 to rotate counter-clockwise and clockwise, respectively, as shown by arrows 103 in FIGS. 4A and 4B. Upon the disengagement of the slip-joint 60, the keyed pivot pin 48 will move to the second aperture 106 as shown in FIG. 4A. The outward movement of the handles 16 and 18 when unlocked continues until the arms 62 and 63 contact the stop 28, but the bias force remains thereon and this further aids in opening the upper jaw member 20 and the lower jaw member 22 to the second maximum jaw opening position 92 being the larger opening between the jaw faces 68. As seen in FIG. 3A, the abutment force acts to rotate the lower jaw member 22 in a clockwise direction as a result of a pivot location 41. The bias force from the biasing means 93 automatically returns the handles 16 and 18 to the unlocked position shown in FIG. 3A after being squeezed together and released.

Figure 4C:
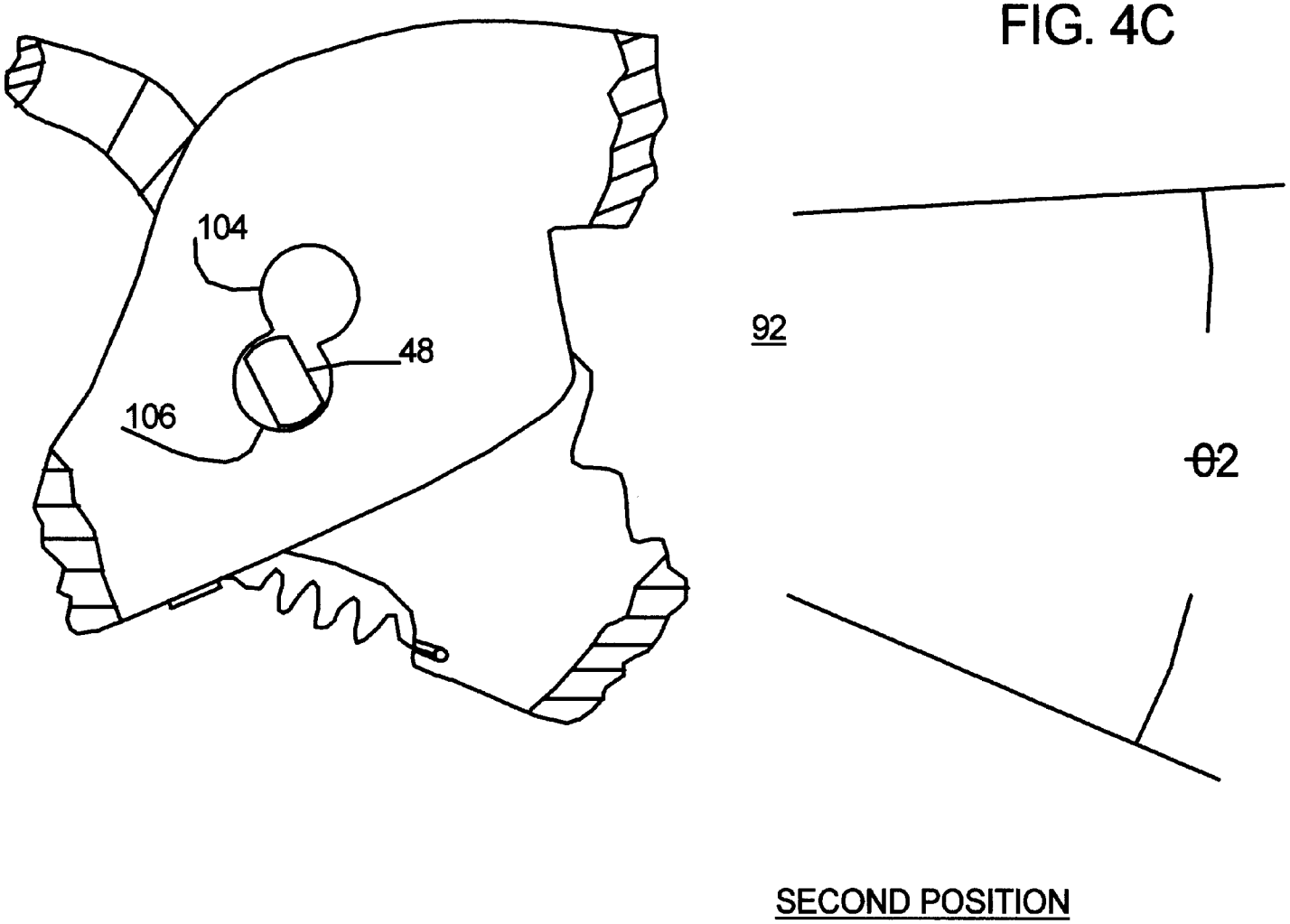
FIG. 4C is a partial side elevation view of the pliers of FIG. 4B with the nut and washer removed from the keyed pivot pin to reveal the keyed pivot pin within the second aperture of the slip-joint of the pliers in a second maximum jaw opening position being defined as a larger opening therebetween in the embodiment having two apertures.

In order to further understand the operation of the adjustable slip-joint 60, reference is made to FIGS. 4A to 4C, in sequence. As seen therein, a first aperture 104 being an essentially circular channel through the body of the upper jaw member 20 and a second aperture 106 are connected by the neck opening 108 forming an overall shape like the number 8. The first and second apertures 104 and 106 are circular in shape and pass through the upper jaw member 20. A first aperture 109 in the lower jaw member 22 (FIG. 4D) is aligned with either the first or second aperture 104 and 106 of the upper jaw member 20. These apertures being of essentially the same diameter in this embodiment. The end 84 of the keyed pivot pin 48 (FIG. 5A) is inserted into the first aperture 109 of the lower jaw member 22 and into either the first or second aperture 104 or 106 before a washer and nut are attached thereon so as to allow sufficient clearance for the rotation of the jaw members 20 and 22 under the spring bias of spring 94.

FIG. 4A represents the adjustable slip-joint 60 in the first maximum jaw opening position 90 having the smallest opening for the work piece. Without the nut and washer thereon, the pivot pin 48 has the flat side 86 that is longer than the threaded side 88 so that the end 84 will not fit through the neck opening 108 until the threaded side 88 is almost perpendicular to a center line 112, following on the two centers of the two apertures 104 and 106. As seen in FIG. 4A, the flat side 86 is almost perpendicular to the center line 112 and is larger than the width of the opening in the neck opening 108 and has a width slightly less than the diameter of the apertures 104 and 106. The lever 46 is biased against the stop 52 on the upper jaw member 20 and the lever 46 has a keyed aperture 114 (FIG. 5C) that fits closely over the end 84 and lies in sliding contact between the pivot pin head 116 (FIG. 5A) and a side 118 of the lower jaw member 22, the pivot pin 48 is held in the position shown relative to the center line 112 by biasing spring 56. The lower jaw member 22 may rotate about the pivot pin 48 that fits closely within the first aperture 109 (FIG. 4D) and thus the pliers 10 will remain in the first maximum jaw opening position 90 until the lever 46 is rotated away from the stop 52 a sufficient angle to cause the pivot pin 48 to rotate in the clockwise direction as shown in FIG. 4A to the position shown in FIG. 4B where the threaded side 88 is substantially aligned with neck opening 108. Because of the spring bias of the spring 94 against the pivot arms 64 and the abutting of the arms 62 and 63 against the stops 28 (FIG. 3A), the upper and lower jaw members 20 and 22, respectively, will be forced farther apart causing the pivot pin 48 to drop into the second aperture 106, FIG. 4C, thus placing the jaw faces 68 (FIG. 3A) in the second maximum jaw opening position 92 for holding a larger work piece.

Figure 13:
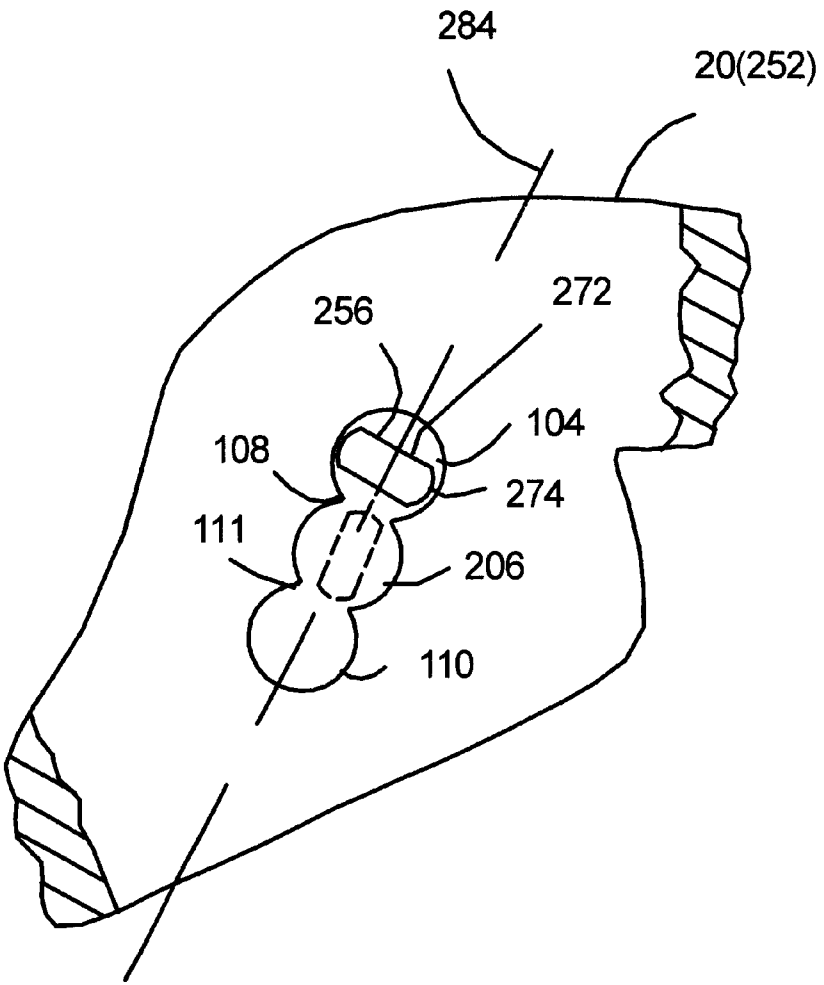
FIG. 13 illustrates by a side elevation view a jaw member having three connected apertures for providing three different maximum jaw opening positions without the keyed pivot pin therein.

In a still further embodiment, a third maximum jaw opening position having an angle of separation greater than that of the second maximum jaw opening position 92 is provided for as shown in FIG. 13 wherein the upper jaw member 20 has a third aperture 110 connected to the second aperture 106 by a neck opening 111 similar to neck opening 108. The apertures being in substantial alignment. When the pivot pin 48 is rotated as shown in FIG. 4A and 4B, the pivot pin 48 will drop into the third aperture 110. The diameter of the apertures and the pivot pin must be designed and configured to fit within the upper jaw member 20.

When the upper and lower jaw members 20 and 22, respectively, are closed on the work piece from either the first position or the second position, the lower jaw member 22 rotates on the pivot pin 48 which has a diameter, measured from the short sides, slightly less than the apertures.

In order to return the pliers 10 from the second maximum jaw open position 92 to the first maximum jaw opening position 90, the following operation must occur: firstly, the left hand grasps the upper and lower jaw members 20 and 22, respectively, with the fingers over upper jaw member 20 and the thumb under the lower jaw member 22; secondly, the right hand is moved closer to the jaws so that the right thumb can operate the lever 46; thirdly, the right thumb rotates the lever 46 counter-clockwise sufficiently to disengage the pivot pin 48; fourthly, the left hand squeezes the jaw members 20 and 22 together, changing the position of such from the second to the first position; fifthly, the lever 46 is released to engage the pivot pin 48 in the first aperture 104.

If there is a third aperture 110, the left hand may sufficiently control the movement of the jaw members 20 and 22, after the pivot pin 48 is disengaged, to position the pivot pin 48 in the second aperture 106 rather than the third aperture 110.

Figure 6:
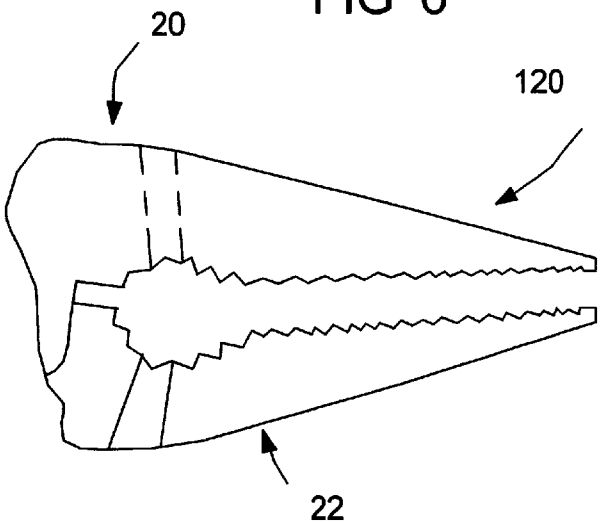
FIG. 6 is a partial side elevation view of another embodiment of the jaws of the pliers of the present invention having a needle nose.

Other features and embodiments are shown in FIGS. 6 to 9, 11 and 12. FIG. 1 illustrates the pliers jaws 38 being of blunt configuration whereas FIG. 6 illustrates the pliers jaws 120 having a needle nose configuration to be able to reach farther and/or into smaller locations.

Figure 7:
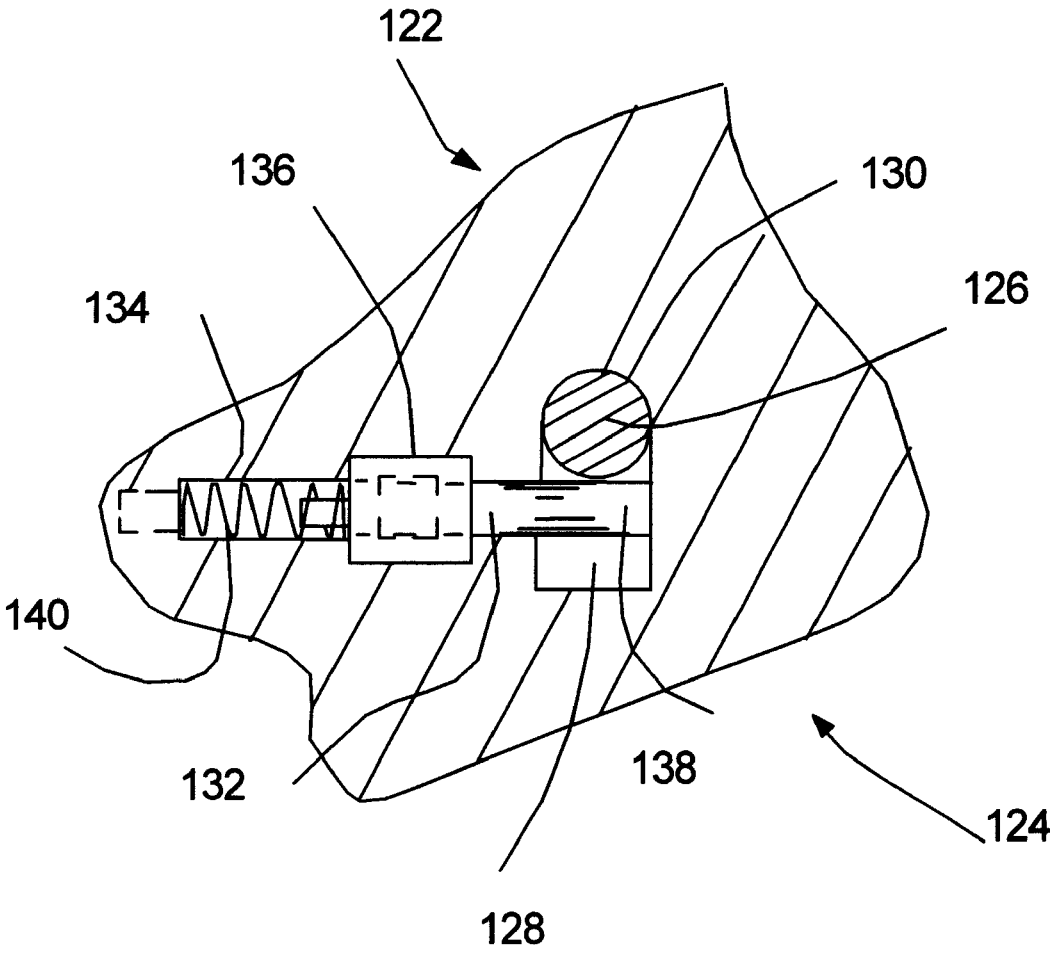
FIG. 7 is a partial side elevation view of a section taken through an upper jaw member having another embodiment of the slip-joint therein.

FIG. 7 illustrates a second embodiment of an adjustable slip-joint 122 showing a vertical cross section through and parallel the side face of an upper jaw member 124. A round pivot pin 126 is positioned within a rectangular cavity 128 having a rounded top 130. The round pivot pin 126 is held in a first position as shown by a horizontal bar 132 mounted to slide within a cavity 134. A finger button 136 is position on the outside of the side face and fixedly mounted to the bar 132. A spring 140 normally biases the bar 132 into the rectangular cavity 128. When the bar is pushed to the left of FIG. 7, a blocking bar 138 is drawn into the bar cavity so that the pivot pin 126 falls to the second position at the bottom of the rectangular cavity 128.

Figure 8:
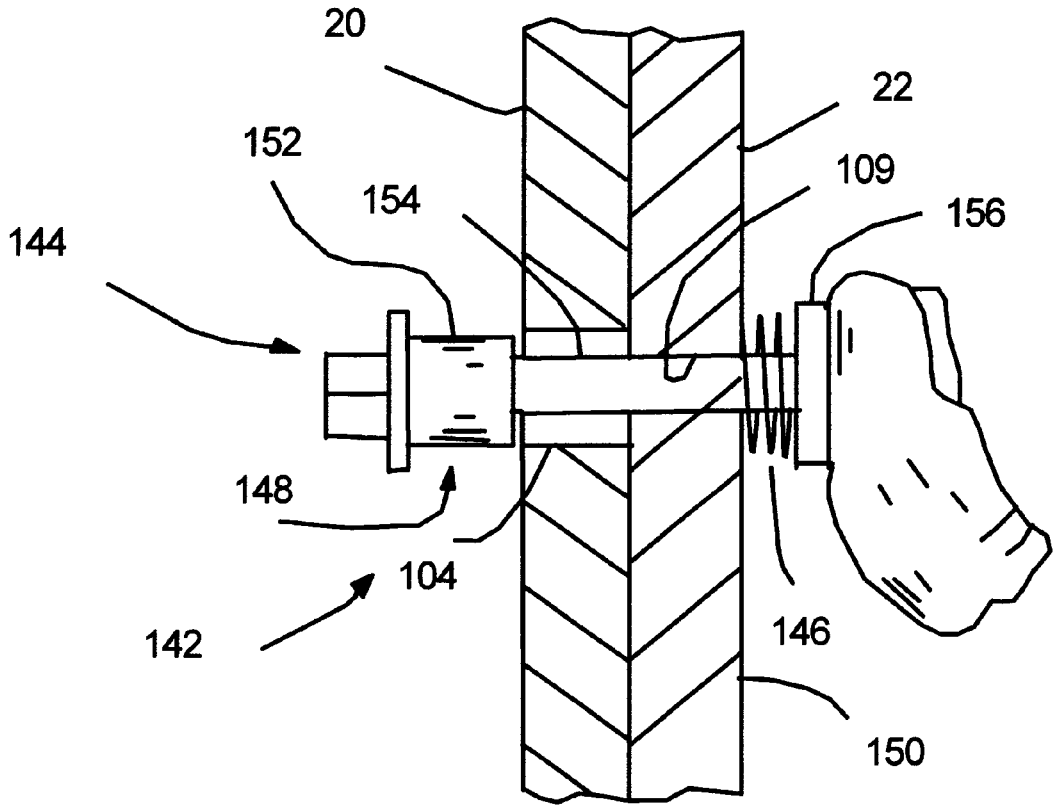
FIG. 8 is a top view of a section taken horizontally through an upper jaw member and a lower jaw member to illustrate another embodiment of a slip-joint therein.

FIG. 8 illustrates by a cross section parallel to the center axis 66 through the first aperture 104 a third embodiment of an adjustable slip-joint 142. The upper jaw member 20 and the lower jaw member 22 are only partially shown. A push-button fastener 144 is shown biased in a released position by a finger of a user where a spring 146 is compressed against the side 150 of the lower jaw member 22. The pivot pin 148 has a large diameter pin 152 and a small diameter pin 154. The small diameter pin 154 fits closely within the first aperture 109 and the large diameter pin 152 closely fits within the first aperture 104 and the second aperture 106, not shown in FIG. 8. The diameter of the small pin 154 is such that only it can fit through the neck opening 108 between the apertures 104 and 106. By pressing on a push button 156, the large diameter pin 152 is translated from the first aperture 104 (FIG. 4A) so that the biasing action of the spring in the handles will force the lower jaw member 22 to move to the second position being the larger opening for a work piece. After the lower jaw member has moved, the push button 156 is released and the large diameter pin 152 will then enter into the second aperture 106, not shown. Operation of the pliers 10 with the three apertures, FIG. 13, would be similar.

Figure 9A:
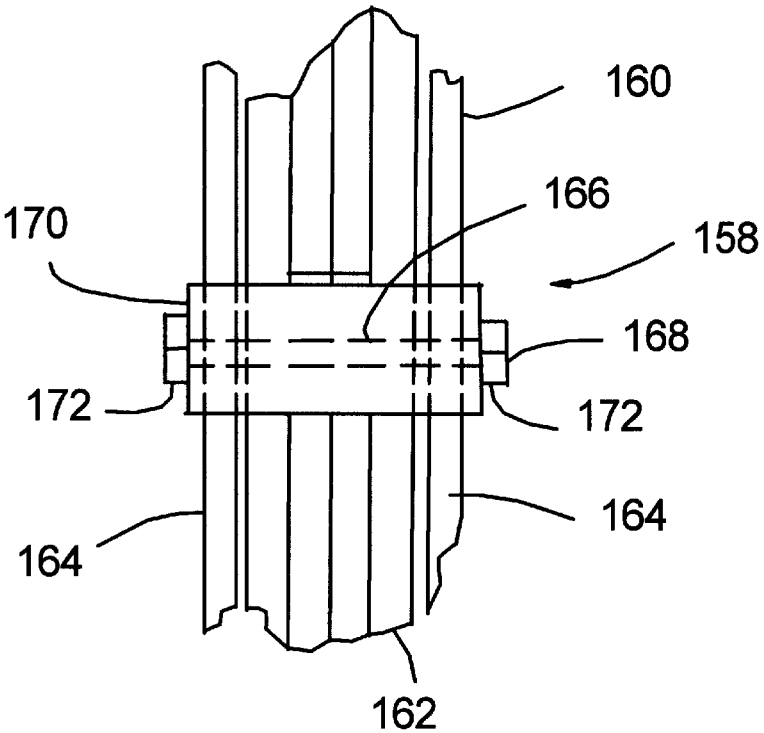
FIG. 9A is a partial top view of another embodiment of a lever placed about the side walls of a laminated set of jaws for moving the keyed pivot pin.
Figure 9B:
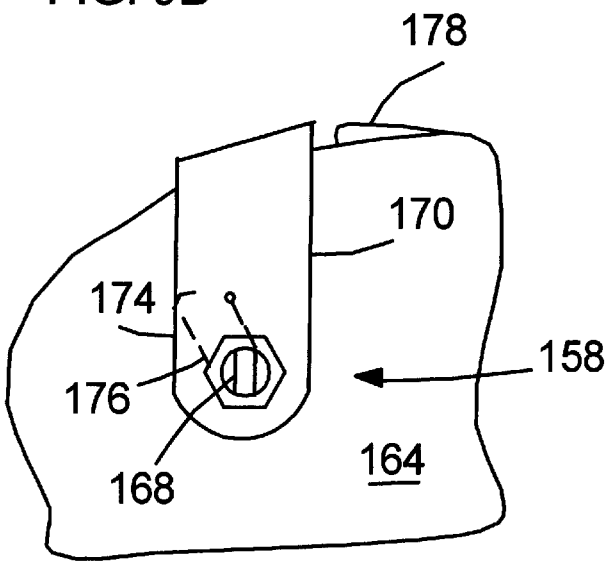
FIG. 9B is a partial side elevation view of the lever of FIG. 9A being spring biased.

FIGS. 9A and 9B illustrate a fourth embodiment of an adjustable slip-joint 158 adapted for use in pliers 10 having a laminated construction of the upper and lower jaw members 160 and 162, shown only partially in these figures. The outer walls 164 would have an aperture 166 similar to that shown in FIG. 4D and the lower jaw member 162 would have apertures similar to that shown in FIG. 4A with a similar keyed pivot pin 168 positioned therein. A U-shaped lever 170 would have the pivot pin 168 fixedly attached thereon by nuts 172 or the like near the bottom of legs 174.

The lever 170 would be biased clockwise by a spring 176 or by other biasing means against a stop 178. By pulling the lever 170 counter-clockwise, the lower jaw member 162 would change from a first position to a second position. By squeezing the jaw members together and pulling the lever 174 back, the pliers would be returned to the first position. The construction of the pliers 10 by laminations of metal sheets is considered conventional and is shown in the prior art examples.

FIGS. 12A and 12B illustrate a fifth embodiment of an adjustable slip-joint 250 adapted for use in pliers 10 having of the upper and lower jaw members 252 and 254, shown only partially in these figures. FIG. 12A is a top view of a cross section through the first aperture 104 and the aperture 109 with a keyed pivot pin 256 therein. A washer 258 is positioned on the pivot pin 256 between a side 260 and a finger operable wing 262 fixedly attached to the pin 256. On the other end of the pin 256 is a cap 264 with a lock nut 266 on the pin 256 to hold the pivot pin 256 within the apertures. The cap 264 has a cavity therein for shielding and protecting stops and springs, for example, therein and rotatably rests upon a side 270 of lower jaw member 254. FIG. 12B illustrates by a side elevation view the means for limiting the rotation of the pin 256 with the cap 264 and lock nut 266 removed. As seen therein, the pivot pin 256 is rectangular shaped with a flat side 272 and a shorter threaded side 274 as the pivot pin 48 shown in FIG. 5A. The stop pin 276 is fixedly attached in the end of the pin 256. A first and second stops 278 and 280 allow the stop pin 276 to rotate about 90 degrees and a clock spring 282 biases the stop pin 276 against the first stop 278. The ends of the clock spring 282 are attached to the stop pin 276 and the side 270. Upon an approximately 90 degree counter-clockwise rotation of the pin 256, the shorter side 274 will be aligned with the neck opening 108 (FIG. 13, three aperture embodiment) in between the first and the second aperture 104 and 106 The spring bias upon the compound handles will cause the pin 256 to drop into the second aperture or third aperture to provide either the second maximum jaw opening position or third as disclosed above. Movement of the compound handles alone is insufficient to change the pin 256 position. Upon release of the wing 262, being defined as a hand operable device, the pin 256 will be engaged in the second aperture 106, not shown, by the clock spring 282 moving the pin 256 back to the first stop 278. The clock spring 282 may not be used but then the user must rotate the pin 256 back to the first stop 278 to engage the pin 256 in the second or first aperture as the case may be. As seen in FIG. 12B, the pivot pin 256 in held in a stationary position, biased thereto by a spring 282, relative to the lower jaw member 254 having the single aperture therein. As seen in FIG. 13, if the flat side 272 of the pivot pin 256 is perpendicular to an aperture axis 284, initially, and the width of the shorter side 274 is closely approximate to that of the neck opening 108, the upper jaw member 252 must be rotated approximately 90 degrees to drop into the second aperture 106 (the rotated pivot pin shown in outline in the second aperture) as is the case of the prior art two position slip-joints, but with the manually adjustable slip-joint 250, rotation of the pivot pin 256 by approximate 90 degree by use of the wing 262, without any movement of the jaw members, will cause the pivot pin to move to the lower apertures. Thus the normal use of the pliers 10 having the slip-joint 250 will not cause a change in the maximum jaw opening position when the pivot pin is held stationary to the lower jaw member 254 as compared to the upper jaw member 252 until the pivot pin is rotated by hand a sufficient amount.

Figure 11:
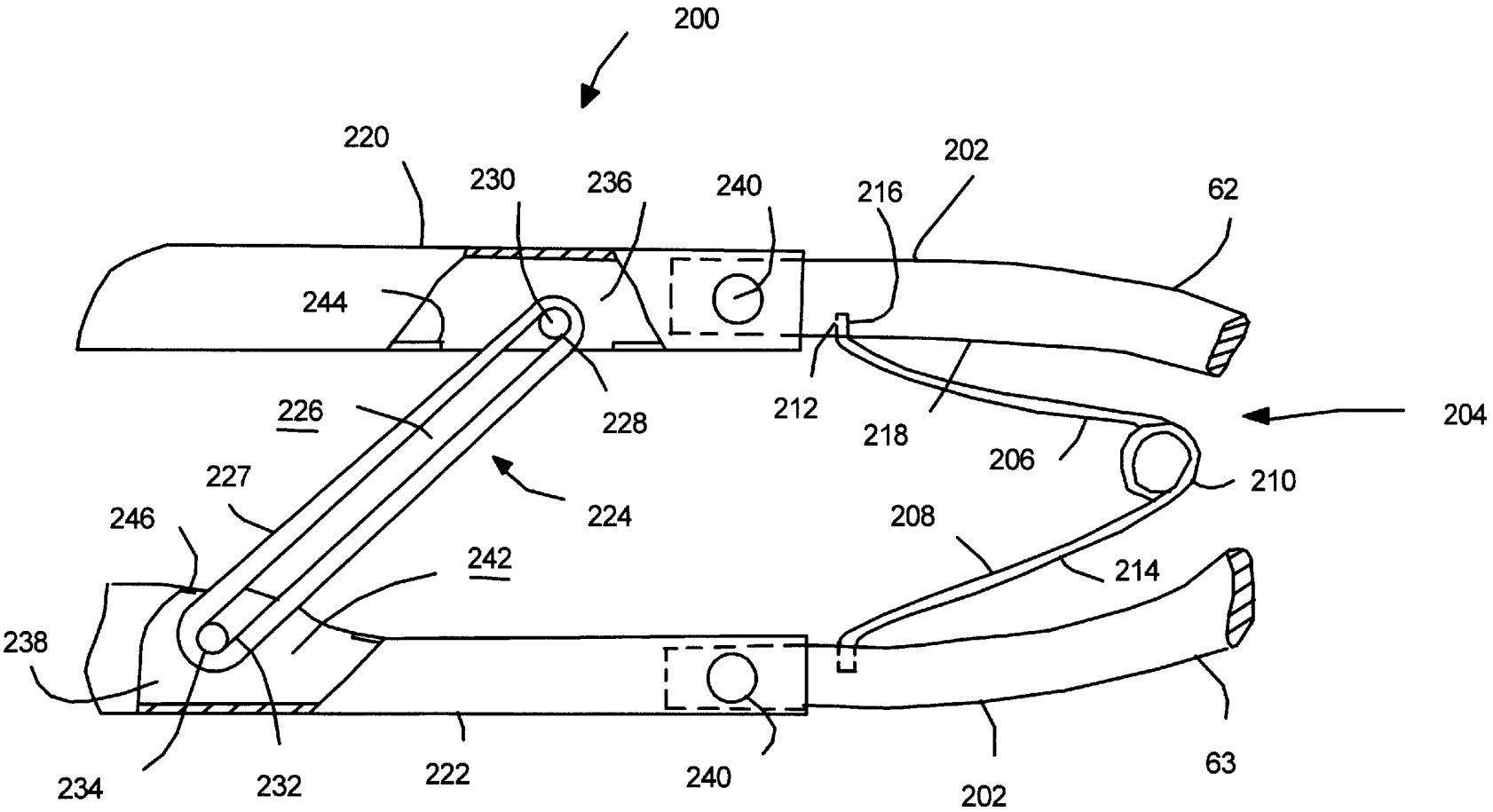
FIG. 11 illustrates by a partial side elevation view pliers of present invention having handles with a sliding limiting bracket to limit movement of the handles.

An embodiment of the present invention without the use of compound handles as described above is shown in FIG. 11 which illustrates a pair of pliers 200 in an unlocked condition such as shown in FIG. 3A of the compound pliers 10. The operation of an adjustable slip-joint, not shown in FIG. 11, is considered to be the same as the adjustable slip-joint 60 shown in FIG. 3A. Also, the pivot arms 64 of FIG. 3A have been replaced with extended arms 202 from the arms 62 and 63 in FIG. 3A. The lower arm 63, FIG. 11, is a part of the upper jaw member 20 and the upper arm 62 is a part of the lower jaw member 22 as seen in FIG. 4A.

The particular embodiment shown in FIG. 11 illustrates the mode of operation of the pliers 200 without the use of the compound handles of the pliers 10. Other variations to achieve the same operation are clearly feasible.

In FIG. 11, a biasing spring 204, has a first spring arm 206 and a second spring arm 208 extending from a coiled spring section 210. The arms 206 and 208 being biased away from each other at all times. At the end of each spring arm is a mounting arm 212 being a bent section, approximately 90 degrees therefrom, of a spring wire 214. This mounting arm 212 is insert into a hole 216 in the extended arm 202 on the inside surface 218. Because the arms 202 are not able to further separated by the spring 204 due to movement restriction, the mounting arms 212 will always remain fixedly attached in the holes 216. Attached to the extended arms 202 are a first and second handle member 220 and 222, respectively. A limiting bracket 224 is pivotally connected between the handles members 220 and 222 as hereafter described.

The limiting bracket 224 is an elongate rectangular body member 227 having an elongate slot 226 therein. The elongate slot 226 has a semi-circular first end 228 with a pivot pin 230 slidably mounted near such and a semi-circular second end 232 with a pivot pin 234 also slidably mounted near such. As seen in FIG. 11, pivot pins 230 and 234 are located at the ends of the elongate slot 226 in the unlocked condition due to the spring biasing provided by the spring 204. The handles members 220 and 222 being unable to further move apart because of the restriction in movement caused by the limiting bracket 224. The handle members 220 and 222 may be squeezed together and locked similarly as shown in the other drawings where the pivot pins 230 and 234 move in a direction to the center of the limiting bracket 224. Sufficient clearance spaces 236 and 238 must be provided at the ends of the limiting bracket 224 within the first and second handle member 220 and 222 when the handles members are placed in a locked condition, if this is provided, or to allow the squeezing of the handle members 220 and 222 to cause the pliers 200 to grasp a working piece, not shown. The handle members 220 and 222 may be covered by a molded plastic covering such as shown in the prior art. The handles 220 and 222 are fixedly attached to the extended arms 202 by means of rivets 240, for example. The handle members 220 and 222 may be made of metal walls such as shown in the prior art and provide a hollow interior 242, partially shown. Longitudinal slots 244 and 246 are formed in the handles through which the limiting bracket 224 is positioned. Other limiting brackets may clearly be mounted in other configurations but these must allow for the squeezing of the handles to grasp the work piece and restrict the outward movement so that the spring 204 remains biased therebetween.

The embodiment shown in FIG. 11 clearly shows that the slip-joint 60 may be used without compound handles. The direction of the forces applied to the upper and lower jaw members of pliers 200 is opposite to that shown in FIG. 4A and thus when the lever 46 of the adjustable slip-joint 60 is moved a sufficient amount in the counter-clockwise direction (see FIG. 1), one of the user's hands must squeeze the upper and lower jaw members 20 and 22 together to obtain different maximum jaw opening positions before the pivot pin 48 is engaged. To return the jaw members to the smallest of the maximum jaw opening positions, the pivot pin is disengaged and jaw members will automatically return to that position due to the biasing force of the bias spring 204. In an alternative embodiment, the biasing spring 204 or the like may be positioned on the other side of the limiting bracket 224 in a similar manner in which case the forces on the upper and lower jaw members would be similar to that shown by the compound pliers.

Clearly many modifications and variations of the present invention are possible in light of the above teachings and it is therefore understood, that within the inventive scope of the inventive concept, that the invention may be practiced otherwise than specifically claimed.

What is claimed is:

1. Improved pliers for gripping work pieces of different sizes requiring different separation angles between jaw faces as determined by a user, said improved pliers comprising:

jaw means for gripping the work piece, said jaw means comprising upper and lower jaw members;

a manually adjustable slip-joint, said manually adjustable slip-joint operably connected to said jaw means for providing rotation and/or translation, said manually adjustable slip-joint providing at least two predetermined maximum jaw opening positions of the upper and lower jaw members by selective adjustment, by said selective adjustment, the jaw members may be moved from one separation angle to another, the selective adjustment occurring with minimum movement of handles of said improved pliers;

biasing means for providing a continuous force to the upper and lower jaw members, said biasing means responding to said selective adjustment of said manually adjustable slip-joint by the user;

handle means, said handle means comprising an upper and lower handles operably connected to the upper and lower jaw members, respectively; and means for limiting the separation of the upper and lower handles, said biasing means cooperatively acting with said means for limiting and said handle means to move said upper and lower jaw members in predetermined directions;

whereby the user selects a separation angle of said jaw means necessary for gripping a given work piece by manually adjusting the slip-joint.

2. Improved pliers as defined in claim 1 wherein said jaw means comprises a pair of jaw members for gripping the work piece, an extension member fixedly attached to each jaw member, and an arm fixedly attached to each extension member.

3. Improved pliers as defined in claim 2 wherein said jaw means is a needle nose jaw means.

4. Improved pliers as defined in claim 1 wherein the handle means is a compound handle means attached to the jaw means.

5. Improved pliers as defined in claim 4 wherein said compound handle means comprises an upper and a lower handle, each having a handle member, further each handle member being pivotally attached to an arm of the upper and lower jaw members, each handle member including a stop and each arm including an abutment, an outward movement of the upper and lower handles being restricted by contact of the abutment on the stop.

6. Improved pliers as defined in claim 1 wherein said manually adjustable slip-joint comprises:

pivot means positioned within said jaw members, at least two apertures of a first jaw member, said apertures being connected by a neck opening for allowing said pivot means to translate and/or rotate from one aperture to another;

an aperture of a second jaw member, said pivot means passing through said aperture of the second jaw member and passing through one aperture of said first jaw member in use;

means for manually adjusting said pivot means to allow said pivot means to pass from one aperture to another aperture of said first jaw member, said means for manually adjusting being able to change the engagement of said pivot means within the first jaw members; and biasing means for providing a continuous force to translate the first and second jaw members upon said pivot means, said biasing means responding to said selective adjustment of said means for manually adjusting.

7. Improved pliers as defined in claim 6 wherein said pivot means comprises a keyed pivot pin, said keyed pivot pin having a rectangular like shape perpendicular to a transverse axis, short sides of said rectangular like shape having a width sufficient to pass through the neck opening, long sides of said rectangular cross section having a width greater than the neck opening, said means for manually adjusting moving said pivot means to pass through said neck opening.

8. Improved pliers as defined in claim 7 wherein said means for manually adjusting comprises a hand operable device fixedly attached to one end of said keyed pivot pin.

9. Improved pliers as defined in claim 8 further including biasing means to hold said hand operable device comprising a lever in a stationary position relative to the first jaw member, said biasing means being a contracting spring to hold a lever against a stop on said first jaw member.

10. Improved pliers as defined in claim 8 further including biasing means to hold said hand operable device in a stationary position relative to the second jaw member, said biasing means being a contracting spring to hold said hand operable device against a stop on said second jaw member.

11. Improved pliers as defined in claim 6 wherein said pivot means is a pivot pin, one end of the pivot pin having a push button thereon, a biasing means being position between said second jaw member and said push button to bias the push button away from said second jaw member, a first section of said pivot pin having a smaller diameter than the second section of said pivot pin, said first section rotatably fitting within the aperture of the second jaw member, the second section rotatably fitting in the apertures of the first jaw member and having a diameter greater than the open neck between the apertures, upon pushing the push button sufficiently, the first section will translate into one aperture of the first jaw member and the biasing means will cause said first section of said pivot pin to translate into another aperture of the first jaw member, said push button being released to engage the second section in an aperture of the first jaw member.

12. Improved pliers as defined in claim 1 wherein the upper and lower jaw members, each having a jaw face opposing the other, may be positioned in at least two maximum jaw opening positions by operating said manually adjustable slip-joint.

13. Improved pliers as defined in claim 1 wherein the jaw means are constructed of laminated sheet metal.

14. Improved pliers as defined in claim 1 wherein said biasing means comprises a coiled spring with spring arms, said spring arms mounted to said arms of said upper and lower jaw members or to said handle means, said biasing means providing a continuous force to separate the handle means, said means for limiting the separation preventing the handles means from separating an amount sufficient to stop the continuous force of the biasing means, upon the actuation of the manually adjustable slip-joint, said biasing means will force said upper and lower jaw members to translate and rotate to place said jaw members in a different maximum jaw opening position.

15. Improved pliers as defined in claim 1 wherein said means for limiting the separation comprises a slotted limiting bracket mounted on pins on the handles means.

16. Improved pliers as defined in claim 5 wherein said biasing means comprises a coiled spring with spring arms, said spring arms being biased away from each other by the coiled spring, said spring arms being mount to arms of said upper and lower jaw members, said biasing means providing a rotational force to separate jaw faces of said jaw members.

17. Improved pliers as defined in claim 5 wherein said manually adjustable slip-joint comprises:

pivot means positioned within said jaw members, at least two apertures of said upper jaw member, said apertures being connected by a neck opening for allowing said pivot means to translate and/or rotate from one aperture to another;

an aperture of said lower jaw member, said pivot means rotating within the aperture of said lower jaw member, said pivot means passing through said aperture of the lower jaw member and passing through one aperture of said upper jaw member;

means for manually adjusting said pivot means to allow said pivot means to pass from one aperture to another aperture of said upper jaw member, said means for manually adjusting being able to change the engagement of said pivot means within the upper jaw member; and biasing means for providing a continuous force to translate the first and second jaw members upon said pivot means, said biasing means responding to said selective adjustment of said means for manually adjusting.

18. Improved pliers as defined in claim 17 wherein said pivot means comprises a keyed pivot pin, said keyed pivot pin having a rectangular like shape perpendicular to a transverse axis, short sides of said rectangular like shape having a width sufficient to pass through the neck opening, long sides of said rectangular cross section having a width greater than the neck opening, said means for manually adjusting moving said pivot means to pass through said neck opening.

19. Improved pliers as defined in claim 18 wherein said means for manually adjusting comprises a lever fixedly attached to one end of said keyed pivot pin.

20. Improved pliers as defined in claim 19 further including biasing means to hold said lever in a stationary position relative to the upper jaw member, said biasing means being a contracting spring to hold said lever against a stop on said upper jaw member.

21. A method for gripping a work piece of a given size by use of improved pliers, said method comprising the steps of:

determining the size of the work piece to be gripped by the improved pliers;

manually adjusting the slip-joint of said improved pliers, said manually adjusting comprising the steps of:

disengaging a manually adjustable slip-joint;

allowing a biasing force to separate jaw means of the improved pliers to position the jaw means in one of a plurality of predetermined maximum jaw opening positions wherein the work piece will be positioned within jaw members;

engaging the manually adjustable slip-joint wherein a user is able to contract handles of the improved pliers to grip the work piece;

engaging the handles of the improved pliers by contracting the handles of the improved pliers upon the work piece in a desired manner;

operating upon the work piece in a desired manner; and disengaging the handles of the improved pliers by releasing the handles from a contracted position of the improved pliers to release the work piece from the jaw members;

whereby the manual adjustment of the slip-joint occurs with a minimal movement of the handles of the improved pliers.

22. A method of gripping a work piece as defined in claim 21 further including the step of disengaging a lock to release the handles of the improved pliers.

23. A method of gripping a work piece as defined in claim 21 wherein there are at least two maximum jaw opening positions to which the improved pliers may be positioned.

24. A method of gripping a work piece as defined in claim 21 further including jaw means being needle nose jaw means.

25. A method of gripping a work piece as defined in claim 21 wherein the operating upon the work piece is straight-on, the jaw members not being offset.

26. A method of gripping a work piece as defined in claim 21 wherein maximum jaw opening positions of the improved pliers may be selectively changed from one to another while the jaw members are positioned in a confined space.

27. A method of gripping a work piece as defined in claim 21 wherein the movement of the handles of the improved pliers is minimal during the manual adjusting of the slip-joint.

28. A method of gripping a work piece as defined in claim 21 further including the handles being compound handles to provide additional force for operating upon the work piece.

29. A method of gripping a work piece as defined in claim 21 wherein the manual adjustment of the slip-joint is selected from the group consisting of rotating a lever, rotating a knob, rotating a wing, pushing a button, sliding a push-button, etc.

30. A method of gripping a work piece as define in claim 21 wherein the handles of the improved pliers may be held in one hand during the manual adjustment of the slip-joint.

31. A method of gripping a work piece as defined in claim 21 further including the use of another hand during the manual adjustment of the slip-joint.

32. A method of gripping a work piece as defined in claim 21 wherein the step of manually adjusting the slip-joint further includes the use of hand force to adjust the jaw means without use of the biasing means.

* * * * *